US007661237B2

(12) United States Patent
Jakob-Bamberg et al.

(10) Patent No.: US 7,661,237 B2
(45) Date of Patent: Feb. 16, 2010

(54) SKIN ATTACHMENT STRUCTURE FOR WALL SYSTEM

(75) Inventors: Rupert Jakob-Bamberg, Calgary (CA); Robert Steeves, Calgary (CA); Steven McIlvenna, Calgary (CA); Kevin T. Domagala, Calgary (CA); Scott MacDermott, Calgary (CA)

(73) Assignee: Haworth, Ltd., Calgary, Alberta (CA)

( * ) Notice: Subject to any disclaimer, the term of this patent is extended or adjusted under 35 U.S.C. 154(b) by 137 days.

(21) Appl. No.: 11/636,878

(22) Filed: Dec. 11, 2006

(65) Prior Publication Data

US 2008/0134610 A1 Jun. 12, 2008

(51) Int. Cl.

| | |
|---|---|
| ***E04B 2/30*** | (2006.01) |
| ***E04B 2/00*** | (2006.01) |
| ***E04B 5/00*** | (2006.01) |
| ***E04B 9/00*** | (2006.01) |
| ***E04C 2/38*** | (2006.01) |
| ***E04F 13/08*** | (2006.01) |
| ***E04H 1/00*** | (2006.01) |

(52) U.S. Cl. ..... 52/506.08; 52/235; 52/386; 52/475.1; 52/489.2; 52/506.05

(58) Field of Classification Search ..... 52/235, 52/384, 386, 475.1, 482, 483.1, 489.1, 489.2, 52/506.01, 506.05, 506.06, 506.08, 506.09, 52/511

See application file for complete search history.

(56) References Cited

U.S. PATENT DOCUMENTS

| | | | | |
|---|---|---|---|---|
| 1,997,581 | A * | 4/1935 | Heeren et al. | 52/506.09 |
| 3,037,590 | A | 6/1962 | Pavlecka | |
| 3,453,794 | A * | 7/1969 | Blok | 52/466 |
| 3,686,810 | A | 8/1972 | Allen | |
| 3,753,325 | A | 8/1973 | Stanley et al. | |
| 4,667,579 | A | 5/1987 | Daw | |
| 4,685,255 | A | 8/1987 | Kelley | |
| 5,481,839 | A * | 1/1996 | Lang et al. | 52/235 |
| 5,644,878 | A | 7/1997 | Wehrmann | |
| 5,845,447 | A * | 12/1998 | Bodine et al. | 52/506.09 |
| 5,899,035 | A | 5/1999 | Waalkes et al. | |
| 6,397,533 | B1 | 6/2002 | Hornberger et al. | |
| 6,446,396 | B1 | 9/2002 | Marangoni et al. | |
| 6,968,661 | B2 | 11/2005 | Kopish et al. | |
| 7,055,287 | B2 | 6/2006 | Yu et al. | |
| 7,168,213 | B2 * | 1/2007 | Rudduck et al. | 52/235 |
| 2002/0134033 | A1 * | 9/2002 | Ishikawa et al. | 52/235 |

* cited by examiner

*Primary Examiner*—Basil Katcheves
*Assistant Examiner*—Branon C Painter
(74) *Attorney, Agent, or Firm*—Flynn, Thiel, Boutell & Tanis, P.C.

(57) ABSTRACT

A snap-on attachment structure for attaching a side skin to an upright frame of a wall system. The attachment structure includes resilient attachment strips secured to the rear of the skin and extending along upright edges thereof. Each strip cooperates with a projection formed on an upright frame member and extending vertically therealong. The snap-on strip has a pair of cantilevered spring legs which protrude outwardly in angled relationship. The spring legs adjacent outer ends are provided with coil-shaped head parts which protrude inwardly toward one another. The head parts have hollow arcuate configurations and move into gripping engagement with shallow arcuate recesses formed on opposite sides of the projection.

12 Claims, 8 Drawing Sheets

SKIN ATTACHMENT STRUCTURE FOR WALL SYSTEM

FIELD OF THE INVENTION

This invention relates to an interior space-dividing wall system and, more specifically, to an improved snap-on engagement structure for attaching a side skin or panel to an upright frame member.

BACKGROUND OF THE INVENTION

Interior space-dividing wall systems, particularly prefabricated wall systems employing generally full-height panels, are frequently defined by a plurality of prefabricated frame members, including horizontal and vertical members, which are assembled to define supportive open frames for the wall system. The resulting open frames are then typically enclosed by large sheet-like skins or panels such as sheets of drywall, glass, wood, metal or other suitable material. These large sheet-like skins are typically provided with an attachment structure on the rear side thereof, which attachment structure frequently employs hooks or other similar constructions which are engaged with a receiving structure associated with the frame members to assemble the skins to the upright frame.

In some known constructions, the engagement structure between the skins and the upright frame elements involves elongate hook strips which engage slots in the upright frame member. Such construction, however, is complex and relatively costly, and can create difficulties with respect to compensating for tolerance variations associated with manufacture and assembly of the wall system.

Another known construction utilizes a deformable mushroom-shaped head associated with a projection mounted on the rear side of the skin, and which is deformably inserted into a recess or groove on the frame for effecting mounting of skin on the frame. While this structure is capable of providing a functional engagement of the skin with the frame, nevertheless this arrangement is not believed to permit any significant compensation for lateral (i.e. horizontal) dimensional tolerances without effecting the gripping engagement of the resilient projection within the frame groove.

Examples of constructions for attaching large skins or panels to frame members are illustrated by U.S. Pat. Nos. 3,686,810, 3,753,325, 4,685,255, 5,899,035, 6,968,661 and 7,055,287.

Accordingly, it is an object of this invention to provide an improved snap-on attachment structure for attaching a large skin or panel to an upright frame element as associated with a wall system, which attachment structure is believed to provide improved performance in comparison to prior known constructions, and which in particular is able to provide for secure mounting of the skin on the upright frame members while at the same time compensating for lateral (i.e. horizontal) dimensional tolerances in the lengthwise extent of the wall system due to tolerances associated both with manufacturing of the components and assembly of the system.

More specifically, the present invention relates to an upright interior wall system having a frame defined by horizontally spaced upright frame elements which are joined adjacent opposite ends thereof by horizontal top and bottom frame members to define open ring-shaped frames which are closed by vertically-oriented panel-like skins attached to one or both sides of the frame to close off the interior thereof. The mounting of the skin on the frame utilizes a snap-on attachment structure defined by vertically elongate resilient attachment strips which are secured to the rear of the skin and extend vertically along the upright edges thereof. Each strip cooperates with a projection formed on the upright frame member and extending vertically therealong, and protruding sidewardly therefrom for cooperation with the snap-on strip. The snap-on strip has, in horizontal cross-section, a pair of cantilevered spring legs which protrude outwardly in angled relationship to one another. The spring legs adjacent outer ends are provided with coil-shaped head portions which protrude inwardly toward one another but are sidewardly spaced apart. The head portions have a hollow arcuate configuration and define a generally cylindrical outer profile similar to a partial cylindrical profile formed by a shallow concave recess in an opposed side of the projection, whereby the head portion on the spring leg can move into secure gripping engagement with the shallow recess formed on the projection. The elongated length and configuration of the spring legs, in comparison to the shape and size of the head portions, permit the snap-on spring strip to compensate for at least limited lateral or sideward displacement of the spring strip relative to the projection, thereby compensating for lateral tolerances due to manufacture and assembly of the wall system.

Other objects and purposes of the invention will be apparent to persons familiar with constructions of this general type upon reading the following specification and inspecting the accompanying drawings.

Figure 1:
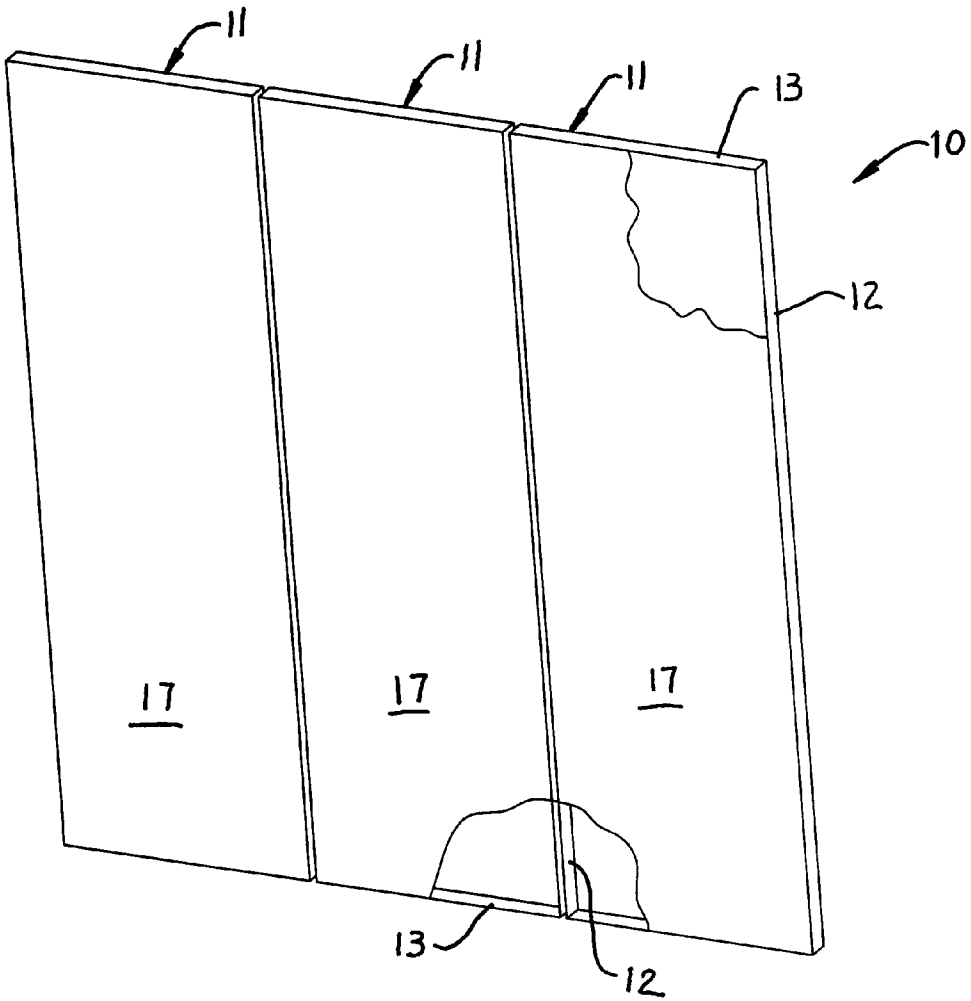
FIG. 1 is a fragmentary perspective view illustrating a wall system having constructional features of the type utilized in accordance with the present invention.

Certain terminology will be used in the following description for convenience in reference only, and will not be limiting. For example, the words "upwardly", "downwardly", "rightwardly" and "leftwardly" will refer to directions in the drawings to which reference is made. The words "upward" and "downward" will also be used in reference to positions or directions associated with the wall system when in its normal upright orientation. The words "inwardly" and "outwardly" will refer to directions toward and away from, respectively, the geometric center of the wall panel and designated parts thereof. Said terminology will include the words specifically mentioned, derivatives thereof, and words of similar import.

DETAILED DESCRIPTION

Figure 2:
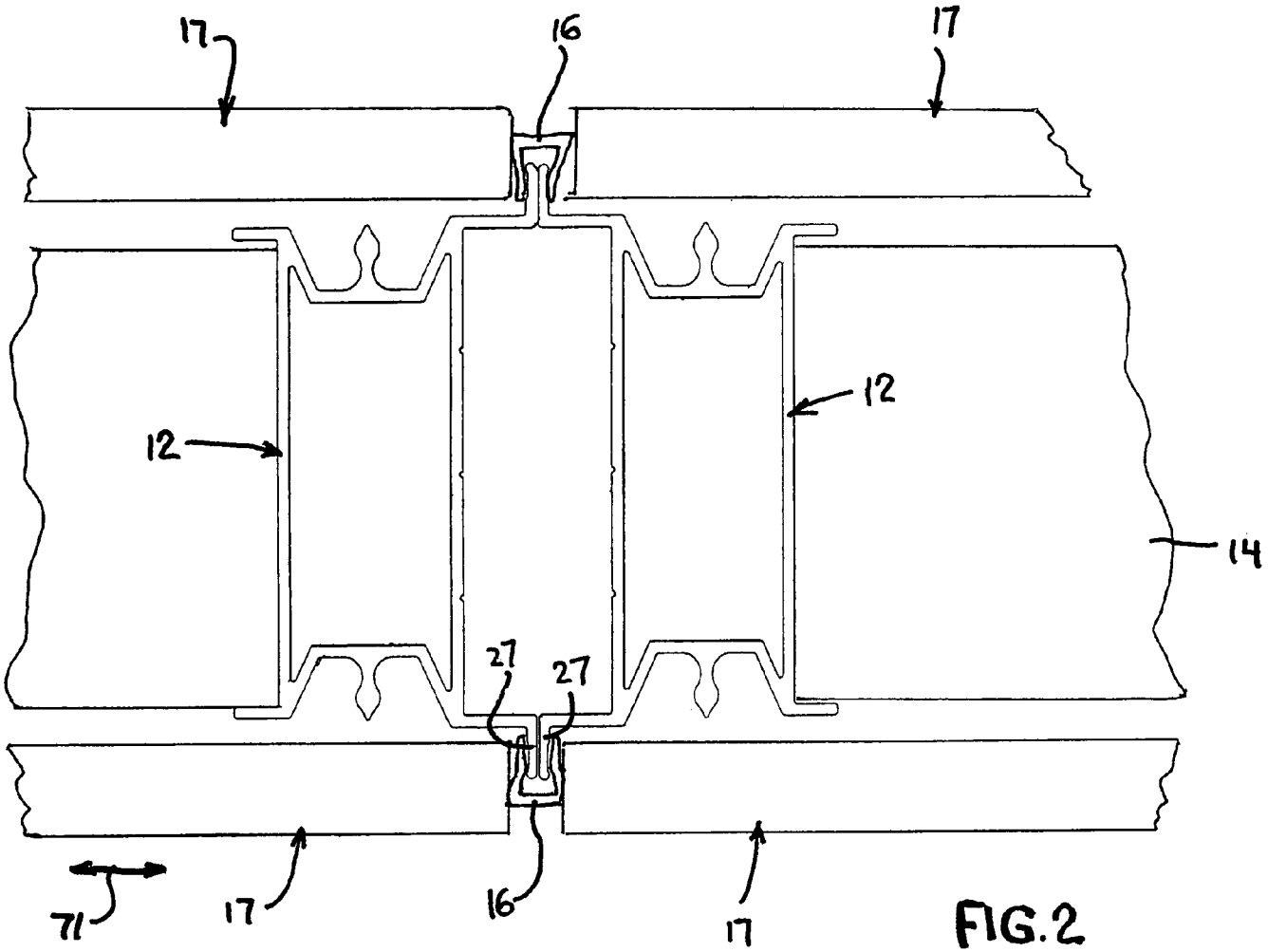
FIG. 2 is an enlarged, fragmentary sectional view taken generally along line 2-2 in FIG. 1, and illustrating skins as associated with opposite sides of the frames associated with the wall system, except that the skins in this view do not have the attachment strips attached thereto for clarity of illustration.

Referring to FIG. 1, there is diagrammatically illustrated an upright interior space-dividing wall system 10 which is defined by a plurality of adjacent wall sections 11 each having its own generally rectangular frame defined by a sidewardly spaced pair of generally parallel upright frame elements 12 which adjacent upper and lower ends are joined together by respective top and bottom horizontal frame elements 13 and 14. The adjacent upright frame elements 12 of adjacent wall sections 11 can be rigidly joined together in a conventional manner. As illustrated in FIG. 2, the adjacent uprights 12 can be provided with abutting protruding flanges 27 which are suitably clamped together by a vertically elongate channel-shaped edge clip 16 so as to rigidly join the adjacent upright frame elements 12 together.

The open interior of the frame defining each wall section 12 is normally closed on at least one side, and typically both sides, by large upright side skins or panels 17 which generally comprise sheet-like or plate-like members which may be constructed from a wide variety of different conventional materials such as wall board, fiber board, plate glass, metal, wood or any other structurally and functionally suitable material. The side skins 17 extend vertically between the top and bottom frame elements 13-14, and horizontally between the sidewardly spaced pair of upright frame elements 12 which define the wall section 11.

In accordance with the present invention, a snap-on attachment structure 18 (FIG. 3) co-acts between and extends vertically along each upright frame element 12 and the overlying vertical edge portion of the side skin 17. This snap-on attachment structure 18 includes a projection or rib 21 which extends vertically along the upright frame member 12 and is cantilevered horizontally sidewardly therefrom, and which cooperates with a vertically-elongate resilient engagement strip or member 22 which is fixedly mounted to the rear side of the side skin and extends vertically therealong in close proximity to one of the upright side edges thereof. The specific construction of the snap-on attachment structure 18 is described in greater detail hereinafter with reference to FIGS. 3-7.

Figure 5:
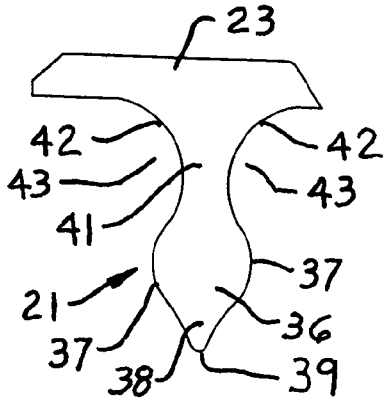
FIG. 5 is a fragmentary enlarged view of solely the attachment projection as associated with each side of the upright frame member.
Figure 4:
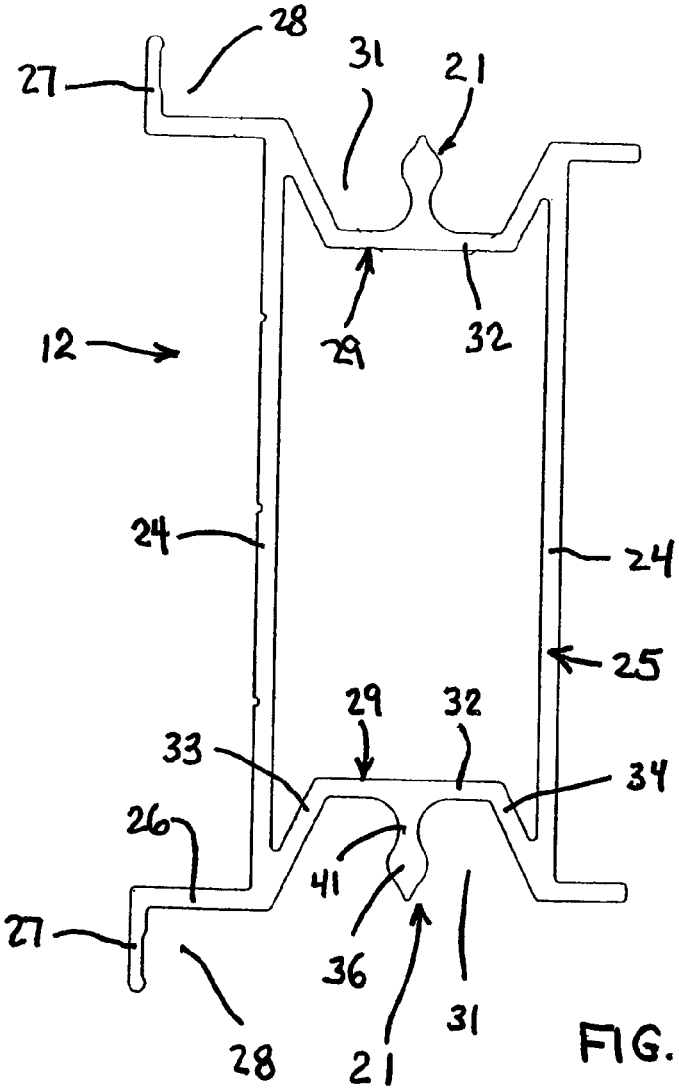
FIG. 4 is a cross-sectional view of solely the upright frame element to which the side panels attach.

The rib or projection 21, as most clearly illustrated in FIGS. 4-5, is fixedly associated with the upright frame member 12 and, in the illustrated embodiment, is a monolithic part of the frame element 12, the latter in a preferred construction being a one-piece aluminum extrusion. The frame element 12 in the illustrated embodiment is formed generally as a vertically elongate tubular member 25 having generally parallel upright walls 24 which project transverse of the wall panel, and which are rigidly joined by wall structures 29 which are disposed adjacent opposite sides of the wall panel. The upright frame member 12 also has a generally L-shaped flange structure cantilevered outwardly from an outer corner and extending lengthwise therealong, which L-shaped flange structure includes a generally upright base wall 26 which, at its outer edge, joins to an edge wall or flange 27 which is cantilevered forwardly from the base wall 26 in generally perpendicular relationship therewith. These walls 26-27 cooperate to define a recess or region 28 which opens outwardly for accommodating therein the upright edge portion of the side skin 17.

The upright outer wall structure 29, which is channel shaped, joins to the base wall 26 and opens inwardly relative thereto, thereby defining a channel-shaped space 31 which opens inwardly relative to the plane of the upright base wall 26 and which extends vertically throughout the height of the upright frame element 12. The channel-shaped wall structure 29 which defines the channel 31 includes an upright back wall 32 which is generally parallel with but displaced inwardly relative to the base wall 26. This back wall 32 joins to rearward edges of a pair of angled side walls 33 and 34 which diverge as they project outwardly toward the plane of the base wall 26.

The back wall 32 has the projection 21 cantilevered generally perpendicularly outwardly therefrom, and extending vertically therealong. This projection 21, which forms one of the cooperating parts of the snap-on attachment structure 18, includes an enlarged head part 36 which is spaced forwardly from the back wall 32 and has generally rounded convex side surfaces 37 defined on opposite sides thereof and extending vertically therealong. The rounded convex side surfaces 37, as they project toward the free end of the projection 21, are each transitioned into a shallow reverse curve so as to define a generally tapered end part 38 which protrudes outwardly and narrows or tapers down so as to terminate in a rounded nose 39, the latter defining the outer free end or extremity of the projection 21.

The enlarged head part 36 is joined to the channel back wall 32 through a bridge part 41 which protrudes perpendicularly outwardly from the back wall 32. This bridge part 41 has a thickness (the horizontal dimension in FIG. 5) which is small relative to the maximum thickness (the horizontal dimension in FIG. 5) of the head part 36. The bridge part 41 has opposite side surfaces thereof defined generally by rounded concave side surfaces 42 which define shallow concave arcuate recesses 43 defined on opposite sides of the bridge part 41. The recesses 43 are defined inwardly of the enlarged head part 36 in close proximity to the back wall 32. The concave side surfaces 42 are preferably defined by a common radius which causes the surface 42 at one end to smoothly curve into the front surface of the back wall 32, and at the other end to smoothly transition into the exterior convex side surface 37 of the enlarged head part 36.

As illustrated by FIG. 4, the projection 21 in its entirety is preferably positioned so as to be located within the confines of the open channel 31, with the nose or free extremity 39 of the projection being disposed so as to not protrude outwardly beyond an exterior upright plane defined by the exterior surface of the base wall 26. In addition, the projection 21 is located generally centrally between the tapered side walls 33-34, whereby significant open regions or spaces are defined on opposite sides of the projection 21.

Considering now the other part of the snap-on attachment structure 18, namely the vertically elongate resilient engagement strip or member 22, it is defined by a one piece spring clip which is carried on the back side of the skin 17 adjacent one of the vertically extending edges thereof and protrudes rearwardly thereof for embracing cooperation with the projection 21.

Figure 6:
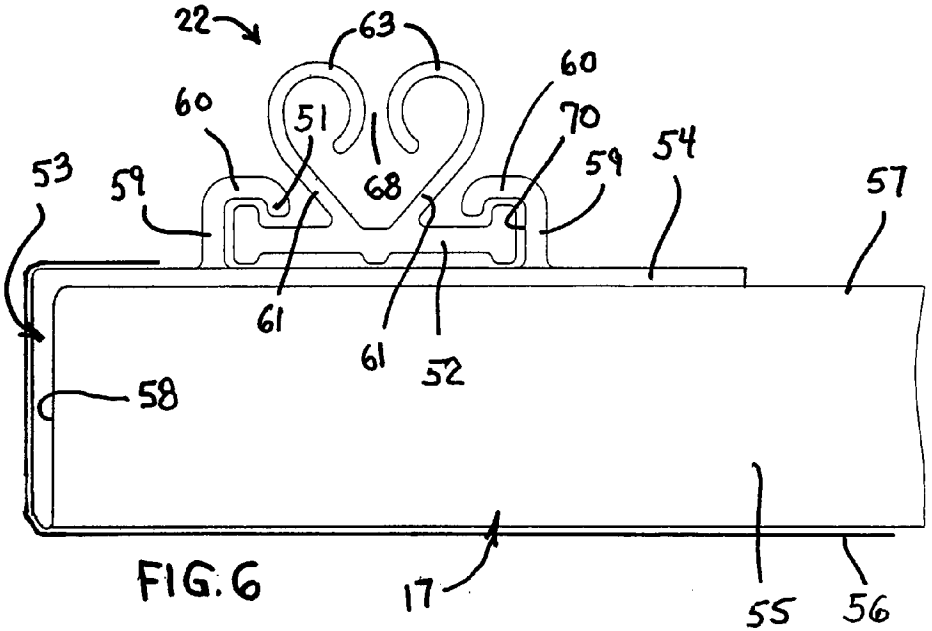
FIG. 6 is a plan view which illustrates one upright edge portion of a side skin, and which specifically illustrates the attachment strip mounted on a rear surface of the side skin.
Figure 7:
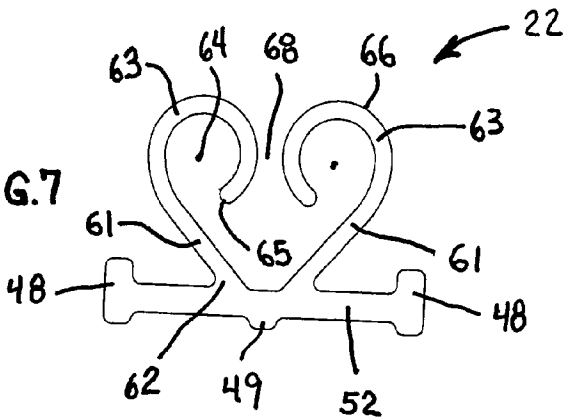
FIG. 7 is a plan or cross-sectional view of solely the attachment strip as appearing in FIG. 6.

The engagement or spring clip 22, as shown in FIGS. 6 and 7, includes a generally flat base plate 52 which is vertically elongated and is adapted to overlie the rear surface of the side skin 17 adjacent one of the vertically extending upright edges thereof, such as the edge 58 as shown in FIG. 6. The base plate 52 is mounted on and engaged with an edge member 54 which overlies the rear surface 57 of the skin and, in the illustrated embodiment, defines one leg of a generally L-shaped corner member 53 which wraps around the corner of the large upright skin member 55. The skin member 55 comprises a large plate-like member, such as a sheet of conventional drywall. The skin member 55 in the illustrated arrangement typically has a thin flexible covering material, such as a flexible plastic or fabric covering 56, stretched over the exposed face of the skin member 55 and wrapped around the edges and adhered thereto, as with an adhesive.

The side skin 17, with the construction as described above and as illustrated in FIGS. 6-7, has the spring clip 22 fixed to the rear edge member 54 adjacent the vertically extending edge 58 of the skin member 55, with the spring clip 22 being vertically elongated and protruding rearwardly so as to create a resilient snap-on engagement with the projection 21 which extends vertically along the respective upright frame member 12.

To permit fixed attachment of the spring clip 22 to the rear edge member 54, the latter is provided with a pair of generally parallel but sidewardly spaced guide rails 59 fixed to and cantilevered rearwardly away from the member 54. The guide rails 59 extend vertically throughout the vertical extent of the rear edge member 54, which vertical extent substantially or approximately corresponds to the vertical height of the side skin 17. The parallel guide rails 59 are positioned in close proximity to but spaced slightly inwardly from the outer edge 58 of the side skin. The guide rails 59 have confining flanges 60 associated with outer edges thereof, which flanges 60 protrude generally inwardly toward one another and, adjacent the inner free edges thereof, are bent inwardly, as indicated at 51, whereby the flanges 60 are generally L-shaped in cross-section. These edge rails 59 and the confining flanges 60 associated with the outer edges thereof, and their cooperation with the plate-like edge member 54, define a channel 70 which extends lengthwise along the side edge of the skin and which opens rearwardly (i.e. outwardly away from the rear surface of the side skin).

The channel 70 is sized and shaped so as to cooperate with and create a confined engagement with the base plate 52 of the spring clip 22. For this purpose, the base plate 52 as illustrated in FIG. 7 has runners or ribs 48 extending along opposite lengthwise-extending edges thereof, which runners or ribs 48 protrude transversely beyond the opposite side surfaces of the base plate 52, that is, beyond the top and bottom surfaces as shown in FIG. 7, thereby creating small top and bottom projections which extend along each lengthwise free edge of the base plate. This base plate 52, as illustrated in FIG. 7, also has a further runner or small projection 49 protruding downwardly from the bottom surface thereof, which runner 49 is disposed substantially at the longitudinally extending centerline of the base plate 52 and extends lengthwise along the base plate in generally parallel relationship to the runners 48. The downward protrusion of the center runner 49 is similar to the downward protrusions defined by the edge runners 48. The runners 48 and 49, and specifically the protrusions which they define relative to the base plate 52, coupled with the construction of the spring clip 22 of a plastics material as discussed hereinafter, enables the protrusions defined by the runners 48 and 49 to elastically deform so as to permit securement of the base plate 52 within the channel 70 defined by the attachment member 54, as hereinafter described.

The spring clip 22 has a pair of elongate spring legs 61 cantilevered outwardly away from the base plate 52, which legs in the illustrated and preferred embodiment are each angled outwardly relative to the base plate 52, with the pair of legs 61 being angled in opposite directions so as to diverge as they cantilever outwardly. The legs 61 in the illustrated and preferred embodiment protrude outwardly at angles of about 45 degrees relative to the base plate 52, with the legs defining an angle therebetween of about 90 degrees.

The spring legs 61 at the inner ends 62 thereof are individually integrally and monolithically joined to the base plate 52 in close proximity to one another. The other or outer ends of the legs 61 are each provided with a rounded and enlarged coil-shaped head part 63 which is designed for gripping cooperation with one side surface 42 on the bridge part 41 of projection 21. The head part 63 is defined generally by an arcuate wall which is generated preferably with a substantially uniform radius about a center point 64, with the enlarged head part 63 being substantially cylindrically generated inwardly from the respective spring leg 61 in a direction toward the opposite spring leg 61. The enlarged head part 63 and its coil-like shape preferably extends through a significant angular extent, such as an angular extent in the neighborhood of about three-fourths of a revolution (i.e. approximately 270 degrees), with the head part 63 terminating at a free end or edge 65 which is spaced sidewardly from the leg 61. The generally cylindrically-generated head part 63 defines thereon a generally cylindrical exterior surface 66 which extends from the free end 65 to its transition into the generally straight spring leg 61.

The coil-shaped head parts 63 as associated with the spring legs 61 are dimensioned so that the head parts 63 are positioned solely in close proximity to the outer extremity of the spring legs 61, with the generally cylindrically-generated head parts 63 being spaced outwardly a substantial distance from the base plate 52.

The enlarged coil-shaped head parts 63 as formed on the outer ends of the straight spring legs 61, and their disposition in sidewardly adjacent relationship between the spring legs 61, results in formation of a narrow gap 68 between the closest extremities of the head parts 63. This narrow gap 68, when the spring legs 61 are in a resiliently non-deflected condition as illustrated by FIG. 7, has a width which is preferably at least slightly less than the narrowest width of the bridge part 41 associated with the projection 21. In addition, the cylindrical exterior surfaces 66 of the enlarged head parts 63 are also preferably generated about a radius which substantially equals, or is only slightly greater than, the radius which generates the rounded concave side surfaces 42 associated with the bridge part 41.

The engagement clip 22, when in a resiliently non-deformed or non-deflected condition as illustrated by FIG. 7, particularly the spring legs 61 and the enlarged head parts 63 associated therewith, has a configuration which generally resembles a heart shape.

Each spring leg 61 and the enlarged head part 63, the latter being substantially an open coil, are defined by a single elongate cantilevered member which is of substantially uniform thickness throughout its length as the member extends from the inner end 62 to the free end 65.

The spring clip 22 is preferably constructed of a relatively stiff but resiliently flexible plastics material, such as polyvinylchloride (PVC) or ABS, and is preferably formed as an elongate extrusion, with the extrusion being cut into desired lengths which are themselves elongate so as to correspond to the various heights of skins with which they cooperate.

A pair of elongate spring clips 22 are attached to the rear of each side skin 17, with the clips 22 being positioned adjacent and extending generally along each of the upright side edges 58 of the skin. The spring clip is initially positioned so that the base plate 52 thereof is aligned with one open end of the channel 70, and the spring clip is then slidably inserted into the channel 70. Thereafter the L-shaped confining flanges 60, either continuously or at spaced locations longitudinally therealong, are physically deformed downwardly using any conventional tool or technique so that the L-shaped confining flanges 60 not only deflect downwardly so as to create a gripping engagement around the outer edge ribs 48, but also effects compressive deformation and hence engagement with the edge ribs 48 so that the base wall 52 of the spring clip 22 is firmly and securely gripped relative to the mounting member 54 and hence cannot be slidably displaced relative to the skin 17, even when the skin is mounted in a vertical orientation on the upright frame of the wall system. The mounting members 54 are generally affixed to the skin member 55, such as with an adhesive, prior to the clips 22 being seated therein.

After identical vertically-elongate engagement strips 22 have been fixedly secured to the back side of the skin 17 adjacent both vertically-extending side edges 58 thereof, then the side skin 17 is oriented vertically adjacent the wall section frame so that the engagement strips 22 are positioned in front of and generally aligned with the respective projections 21 as associated with the frame elements 12. By moving the skin 17 inwardly toward the projections 21, the enlarged heads 36 of the projections 21 enter into the narrow gaps 68, with the engagement between the enlarged heads 36 and the open coils 63 on the spring clips occurring initially with upper portion of the coils 63. This contact between the coils 63 and the rigid heads 36 causes an outward force to be imposed on one or both coils 63. Due to the small and compact geometry of the coil 63 relative to the cantilevered length of the spring leg 61, and the fact that the contact force imposed on the coil 63 is adjacent the outer or upper portion thereof, the coil 63 itself undergoes only little resilient deformation as a result of this force. Rather, the force imposed thereon by the projection primarily effects outward resilient deflection of the elongate leg 61 about its point of joinder 62 to the base plate 52. The opposed legs 61 of each clip 22 hence spring outwardly away from one another until the wide portion of the projection head 36 passes through the narrowest point of the gap 68, following which the spring legs 61 urge the coils 63 inwardly so that the coils 63 are effectively pulled into and snugly seated within the shallow arcuate recesses 43 defined on opposite sides of the bridge part 41. The generally cylindrical outer surfaces defined on the coils 63, due to their geometric compatibility with the generally partial cylindrical concave surfaces 42 defined on opposite sides of the bridge part 41, cause the coils 63 to snugly seat against the concave surfaces 42 so as to embrace the narrow bridge part 41 therebetween, thereby creating not only a vertically long area of engagement substantially throughout the height of the skin, but also creating an area of engagement which is of significant horizontal width due to the exterior surface 66 on the coil 63 effectively conforming to the concave surface 42 defined on the bridge part 41, thereby providing a horizontally wider contact area, whereby the skin 17 is securely engaged and supported on the upright frame elements 12.

While the mounting of the skin 17 on the frame as described above relates to a technique which would be utilized if the entire length of each spring clip were snapped over its projection at substantially the same time, nevertheless it is believed that such technique requires a higher amount of pushing force in order to effect mounting of the skin on the wall system frame. Accordingly, in accordance with a preferred mounting technique, a lower edge of the skin 17 is preferably initially moved inwardly toward the frame so as to effect a snap-on engagement between the projections 21 and the lower ends of the spring clips 22 since this can be effected using much less manual application force. After the lower ends of the spring clips 22 have been engaged with the respective projections 21, then the skin 17 is progressively swung inwardly about the lower edge so as to progressively effect snap-on engagement of the spring clips 22 with the respective projections 21 over the full vertical extent thereof.

With the snap-on attachment structure of the present invention, and specifically the configuration of the spring clip 22 and its mode of cooperation with the projection 21, the spring clip 22 is able to compensate for significant dimensional tolerance variation in the horizontal lengthwise direction of the wall system, namely in the direction indicated by arrow 71 in FIG. 2. Due to manufacturing tolerances associated with the individual components, coupled with tolerances associated with assembly of the components, the buildup of tolerances normally prevents the pair of spring clips 22 as mounted on the skin from being perfectly positioned in aligned relationship with the opposed pair of projections 21. The configuration of the spring clip 22, however, and the fact that the two spring legs 61 thereof angle in opposite directions and are freely resiliently but independently deflectable, in cooperation with the manner in which the coil 63 is defined on the head end thereof, still provides a desired cooperation between the spring clip 22 and the projection 21 since one of the spring legs 61 may be deflected a greater extent than the other spring leg, but when the coils 63 are engaged with the bridge part 41, the coil 63 on one side of the bridge part may have a higher contact engagement pressure against the side of the bridge part than the coil 63 on the other side thereof. The opposed coils 63 on each spring clip 22 thus tend to compensate for one another, depending upon the direction of lateral offset, whereby secure gripping of the skin 17 on the pair of upright frame elements 12 is achieved.

Figure 3:
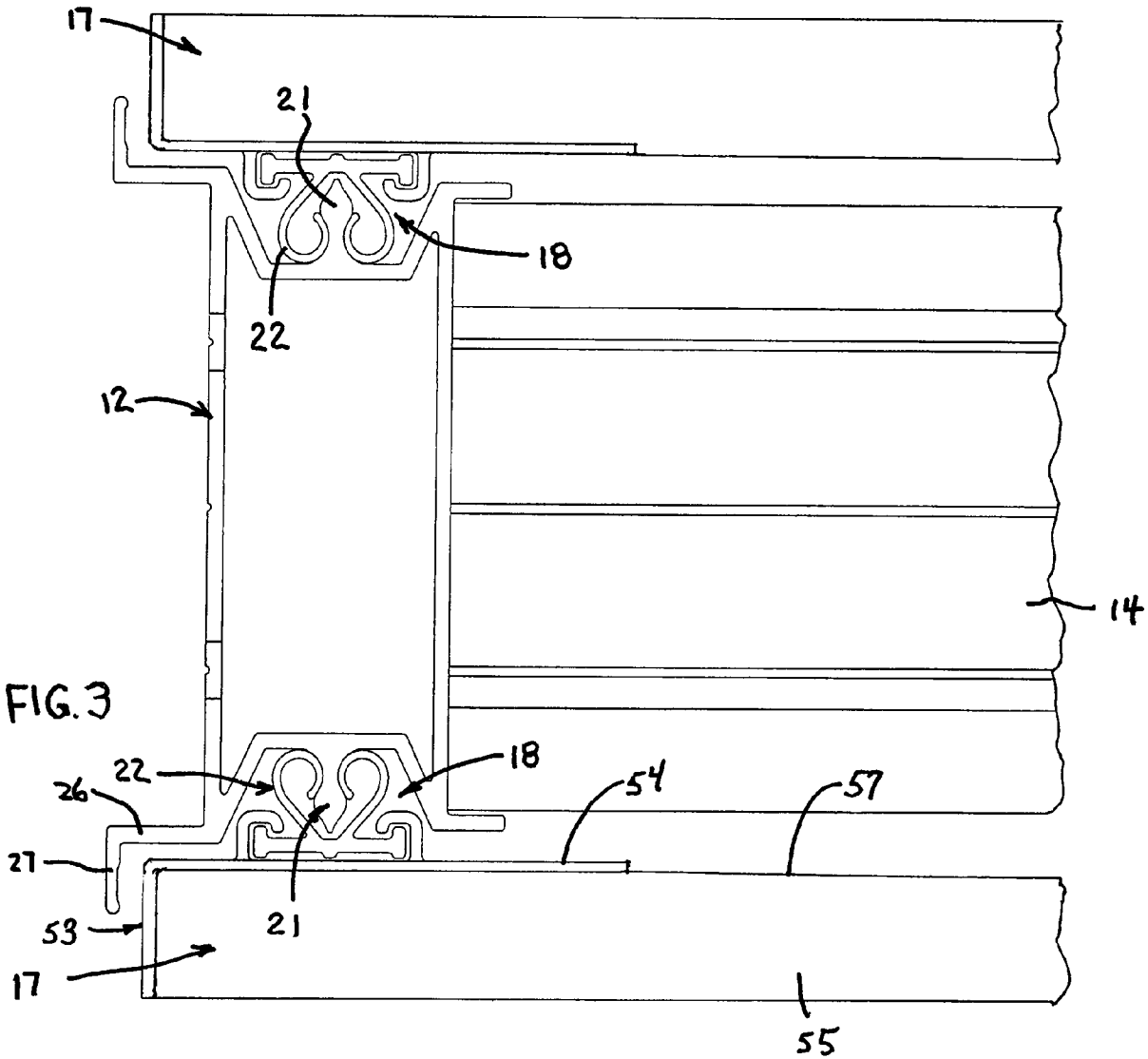
FIG. 3 is an enlarged sectional view which illustrates solely a single upright as associated with one edge of a wall panel section, and which additionally illustrates the side skins which attach to opposite sides thereof.
Figure 8:
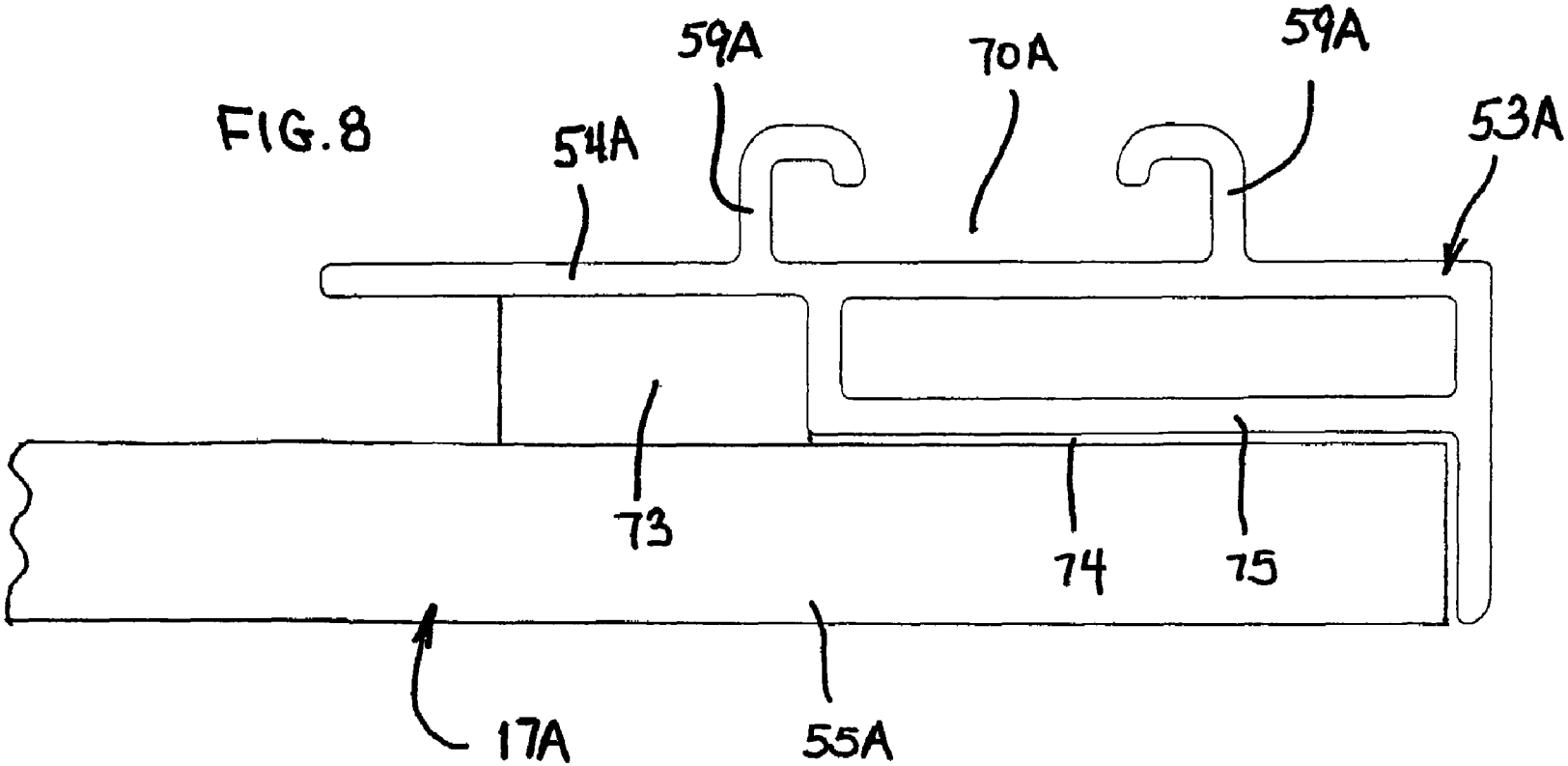
FIG. 8 is a plan view of an upright edge portion of a modified side skin, namely a side skin formed by a glass slab, and illustrating the modified edge member which attaches to the glass slab and mounts the attachment strip thereon.
Figures 9, 10:
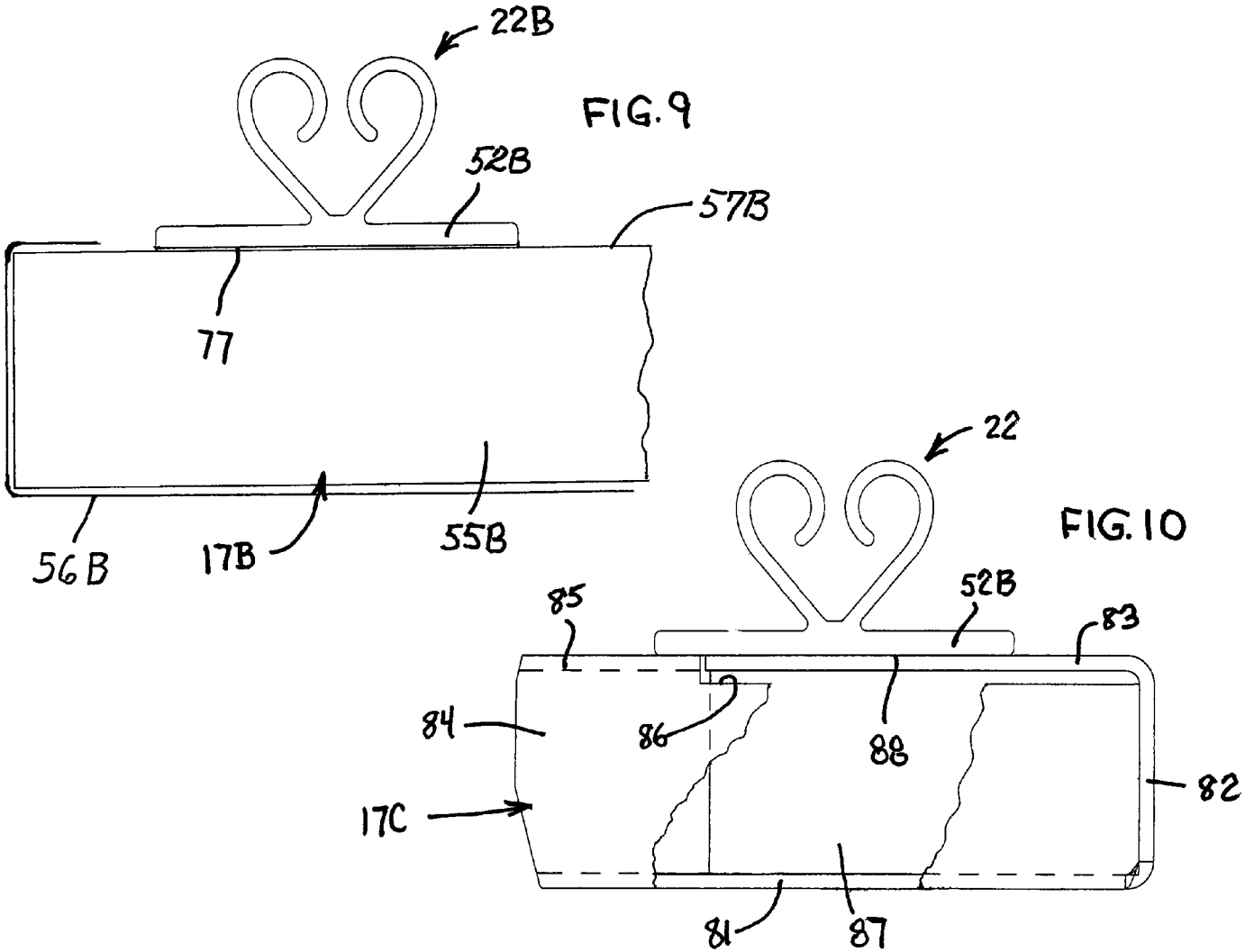
FIG. 9 is a further view similar to FIG. 6 but illustrating a further modification of the side skin, together with a modified spring attachment strip and its attachment to the rear surface of the side skin.
FIG. 10 is a view which illustrates an upright edge portion of another variation of the side skin, and attachment thereto of the spring strip in generally the same manner as illustrated by the variation of FIG. 9.

While FIGS. 3 and 6 as described above illustrate one preferred variation of the skin 17, which variation forms the skin primarily by use of a large sheet 55 of conventional drywall, it will be appreciated that the skin may involve numerous other constructional variations, and typical examples thereof are illustrated by FIGS. 8-10 as described hereinafter.

In the skin variations illustrated by FIGS. 8-10, the parts thereof are designated by the same reference numerals utilized to designate corresponding parts in the variation of FIG. 6 except for addition of the alphabetic character A, B or C thereto.

Referring initially to FIG. 8, the side skin 17A in this variation includes a large plate-like side panel 55A defined by plate or laminated glass, with the vertical edges of the glass again having mounting members 53A attached thereto and extending vertically therealong for permitting attachment of the spring clips 22 as illustrated by FIG. 7. The mounting element 53A is again a generally L-shaped member having a rear wall 54A and a side or edge wall which overlaps the upright edge of the panel 55A. Since the thickness of the glass panel 55A is less than the thickness associated with the drywall panel 55, however, and to provide for securement of the glass panel 55A to the mounting member 53A, the mounting member 53A includes a protruding step or shoulder structure 75 formed in the inside corner thereof and projecting vertically therealong. The glass panel 55A is seated against this shoulder 75, with a double sided adhesive foam tape 74 being positioned therebetween so as to permit initial positional securement of the glass panel 55A to the mounting member 53A. In addition, an adhesive bead 73 is created in the region between the rear wall 54A and the rear surface of the glass panel 55A so as to create a fixed securement of the glass panel 55A to the mounting member 53A. This adhesive bead 73 may be defined by a clear silicone adhesive.

The side skin 17A employing the glass panel 55A is provided with guide rails 59A associated with and projecting rearwardly from the rear wall 54A so as to enable the base wall 52 of the clip 22 (FIG. 7) to be slidably inserted therein, with the rails 59A being deformed to effect secure locking and deforming engagement with the runners 48 provided on the spring clip 22 to fixedly secure the latter to the side skin 17A.

Referencing now FIG. 9, there is illustrated a side skin 17B according to a further variation. The side skin 17B in this variation is formed principally by a sheet or plate-like member 55B which comprises wood such as plywood or MDF board. The wood sheet is typically wrapped in a thin sheet of flexible covering material 56B such as plastic or fabric, which covering sheet extends across the entirety of the exposed vertical front face and then wraps around the peripheral edges of the sheet, the covering sheet being adhesively secured to the member 55B.

In the skin 17B of this variation, however, the skin is not provided with a separate mounting element, but rather a modified attachment clip 22B is attached directly to the rear surface 57B of the skin panel 55B. The modified attachment clip 22B is identical to the construction of the clip 22 illustrated in FIG. 7 except that the base plate 52B of clip 22B is not provided with runners or transverse projections, but rather is formed generally as a flat plate, and the transverse width of this flat plate 52B is typically somewhat greater than the width of the base plate 52. The modified clip 22B is initially fixedly secured to the rear surface 57B of the skin member 55B by a layer of double-stick tape 77. After the clip 22B has been fixed to the skin plate 55B by the double-stick tape, then a plurality of fasteners such as staples are inserted through the base plate 52B at a plurality of locations spaced lengthwise therealong for penetration into the skin member 55B to effect rigid securement of the attachment clip 22B thereto. The increased transverse width of the base plate 52B provides increased accessibility for applying the fasteners (i.e. staples) which secure the base plate 52B to the skin panel 55B.

FIG. 10 illustrates a side skin 17C according to a still further variation wherein the side skin is defined by a large generally flat sheet of metal 81 which defines the exposed vertical front face of the side skin. The vertical and horizontal edge portions of the front metal face 81 are suitably bent to define the side edges of the skin. For example, the vertical side edges of the front metal face 81 are bent to define rearwardly projecting side edges 82 which, at their rearward edges are bent inwardly to define rear flanges 83 which are spaced rearwardly from the front face 81. In similar fashion the horizontal (i.e. top and bottom) edges of the front metal plate 81 are bent rearwardly to define inwardly protruding horizontal flanges 84 which at their rear ends are bent vertically to define rear flanges 85. These latter flanges, adjacent the vertical edges of the side skin, have cut-outs 84 so as to provide clearance for the vertical rear flanges 83. The thin metal sheet defining the side skin 17C is suitably formed around and reinforced by an interior ring-shaped wood frame which extends interiorly around the periphery of the shaped metal skin, one element 87 of the wood frame being illustrated in FIG. 10 and being positioned to extend vertically along one edge thereof and being suitably confined within the edge portion so that the vertical bent edge 82 and the rear flange 83 wrap around the wood frame element 87.

The skin 17C of FIG. 10, along each of the vertically extending edge portions, has one of the vertically-elongate attachment clips 22B fixedly attached thereto. The clip 22B in the variation of FIG. 10 is attached in the same manner as in the variation illustrated by FIG. 9, namely the base plate 52B is initially fixedly secured to the rear surface of the metal edge flange 83 by means of a double-face tape stuck therebetween, and then fasteners such as staples are penetrated through the base plate 52 and through the metal rear flange 83 into the underlying wood frame element 87.

The constructional variations of the side skin illustrated by FIGS. 8-10 cooperate with the wall system frame in the same manner described above relative to the side skin 17, so that further detailed description with respect to attachment of the side skin to the frame is believed unnecessary.

With the improved attachment structure of the present invention, which attachment structure includes a vertically elongate resilient attachment clip 22 secured to the rear of the vertically large plate-like side skin adjacent each vertically-extending edge thereof, and its cooperative engagement with a vertically elongate rib 21 which extends along and is horizontally cantilevered outwardly from a respective upright frame element, the resulting cooperation between the clips 22 and the projections 21 on the frame elements facilitates engagement of the clips 22 on the frame by enabling a progressive snap-on engagement to occur along the vertical height of the frame elements so as to simplify mounting of the side skins on the frame at the job site. At the same time the construction of the clips 22 and their cooperation with the projections 21 readily compensates for lateral tolerances, even though such tolerances may be of sufficient magnitude, such as in the order of 1.0 to about 1.5 millimeters in either sideward (i.e. horizontal) direction, without degrading the quality of the frictional engagement which is created between the resilient heads of the spring clips and the opposed engagement walls associated with the projections. Maintaining this desired frictional engagement force is critical to prevent the side skin from sliding downwardly to its lowermost extremity position since, if the frictional engagement is insufficient to prevent downward sliding of the side skin, then such would destroy the aesthetics of the assembled wall in that the horizontal edges or line features (such as upper and lower edges) associated with sidewardly adjacent wall sections would not properly align. In the arrangement of this invention, the frictional properties associated with the plastic attachment clips 22, and their cooperation with surfaces defined on the projections 21, the latter preferably being raw mill-grade aluminum, hence provide the desired frictional forces necessary to securely hold the side skin in position and prevent it from sliding vertically downwardly along the frame elements.

Figure 11:
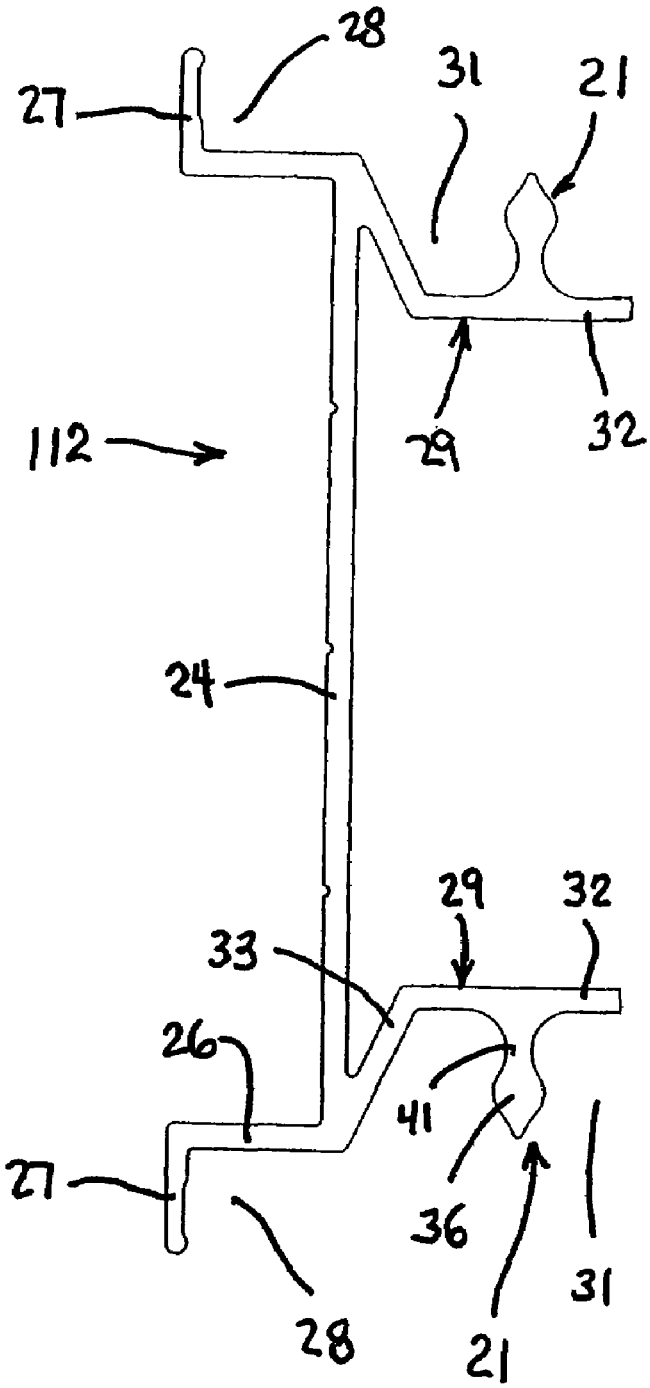
FIG. 11 is a cross-sectional view similar to FIG. 4 but illustrating a variation in the construction of the upright frame member.

Referencing FIG. 11, there is illustrated a modified construction of a frame upright 112 which corresponds generally to the upright 12 which has a closed box shape cross section, whereas modified upright 112 has only a single transverse wall and is closer to an I-shaped cross section. The modified upright 112, however, has the same structural features such as the edge flanges 27, and the projections 21. This upright 112 cooperates with skin clips 21, etc., in the same manner as described above.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An upright wall system, comprising:

an upright frame structure including a plurality of elongate frame members interconnected to define one or more open areas which open horizontally through the frame structure, said plurality of frame members including a pair of upright frame members which are disposed in sidewardly spaced and generally parallel relationship and which define said one open area therebetween, said upright frame members having opposite base walls which extend vertically and face sidewardly wherein said base wall on each respective side of said frame structure lies coplanar within a respective vertically-extending side plane, said upright frame members further including a channel wall structure displaced inwardly from a respective said base wall of each of said upright frame members wherein each said channel wall structure defines a vertically elongate channel having a channel mouth which opens sidewardly through said side plane;

a large vertically-extending side skin positioned adjacent one side of said frame structure and extending horizontally between said pair of upright frame members for closing off said one open area, said side skin having an interior face defining a rear side and having vertically-extending edge portions which are respectively positioned in engaged relationship with a respective one of the upright frame members wherein said interior face is disposed closely adjacent to and substantially parallel to said side plane; and a snap-on attachment structure extending vertically along and creating a cooperative engagement between each said upright frame member and the respectively adjacent upright edge portion of said skin for fixedly attaching the side skin to the frame structure;

said snap-on attachment structure including a vertically elongate attachment clip mounted on said rear side of said side skin adjacent an upright edge thereof, said attachment clip being cantilevered generally horizontally outwardly away from the rear side of said skin and projecting into said channel of the respective upright frame member inwardly of said side plane;

said snap-on attachment structure also including an elongate attachment rib fixed to and extending lengthwise of said upright frame member within said channel and cantilevered horizontally outwardly from said channel wall structure in a direction toward the interior face of said skin and terminating in a free end disposed inwardly of said side plane;

said attachment rib including an enlarged head part adjacent the free end thereof which terminates at said free end inwardly of said side plane, said enlarged head part having oppositely-facing side surfaces provided with a convex rounded profile, said side surfaces defining a first width therebetween which constitutes the maximum transverse width of the attachment rib;

said attachment rib also including a bridge part which is disposed horizontally inwardly from the enlarged head part within said channel and which rigidly joins to an upright wall of said upright frame member, said bridge part being defined between oppositely facing side surfaces which are concavely smoothly rounded and which respectively merge into the convex rounded side surfaces of the enlarged head part, said bridge part having a minimal transverse width as defined between the concavely rounded side surfaces which is substantially smaller than the maximum width defined by said enlarged head part; and said attachment clip including a vertically-elongate wall base which is fixedly carried on said side skin adjacent the interior face thereof, and a pair of sidewardly-spaced vertically-elongate spring legs fixed to and cantilevered rearwardly from said wall base for sideward straddling engagement with the adjacent attachment rib, each said spring leg having thereon an enlarged head part defined by a coil-shaped sector which is integrally joined to the spring leg adjacent a free end thereof and which is coiled inwardly through an angular extent of at least approximately 270 degrees so as to be convexly rounded and project inwardly toward the enlarged head part fixed to the other spring leg, the enlarged head parts being positioned in sidewardly adjacent but sidewardly spaced relation to define a gap therebetween having a minimal width which is less than the minimal width of the bridge part when the spring clip is in a resiliently non-deflected condition, the coil-shaped head part associated with each spring leg being spaced outwardly a substantial distance away from the wall base, and said coil-shaped head parts having an exterior configuration which is compatible with and generally conforms to the shape of the concave rounded side surfaces defined on opposite sides of the bridge part for permitting the bridge part to be gripped between the coil-shaped head parts when the attachment clip is snappingly engaged over the attachment rib.

2. A wall system according to claim 1, wherein the spring legs when in a resiliently non-deflected condition are joined to and angle outwardly away from the wall base in non-perpendicular relationship therewith, with the pair of spring legs diverging with respect to one another as they project outwardly away from the wall base.

3. A wall system according to claim 2, wherein the attachment clip has a generally heart-shaped cross-section.

4. A wall system according to claim 1, wherein said pair of spring legs are integrally and monolithically joined to said wall base and protruding outwardly therefrom in sidewardly spaced relationship so as to be disposed on opposite sides of a center plane which perpendicularly intersects said wall base, said spring legs and the enlarged head parts associated therewith being identical but mirror images of one another as positioned symmetrically on opposite sides of said center plane.

5. A wall system according to claim 4, wherein each spring leg adjacent the free end thereof is integrally joined to the coil-shaped head part so that the spring leg and the integral head part are of substantially uniform thickness from the point of connection to the wall base to the free end of the enlarged head part.

6. A wall system according to claim 5, wherein the free end of the coil-shaped head end is oriented so as to point generally in a direction toward the wall base, the free end being transversely spaced from the wall base by a first distance, the spring leg with the enlarged head part thereon projecting transversely from the base wall by a second distance, and said second distance being at least approximately twice said first distance.

7. A wall system according to claim 1, wherein said attachment clip is a monolithic one-piece member formed of a stiff but resiliently deflectable plastics material.

8. A wall system according to claim 1, wherein said wall base directly overlies said interior face of said side skin and is fixedly attached thereto by a double-faced adhesive tape, and a plurality of fasteners extending through said wall base at spaced locations therealong for penetration into said side skin for fixedly attaching the attachment clip to the skin.

9. A wall system according to claim 1, wherein said wall base is substantially aligned with said channel such that said wall base projects at least partially into said channel mouth after engagement of said attachment clip and said rib.

10. A wall system according to claim 9, wherein said wall base is disposed on said interior face of said side skin wherein said spring legs and a portion of said wall base are insertable in said channel to position said interior face of said side skin closely adjacent said side plane.

11. A wall system according to claim 10, wherein said side skin has a vertically elongate mounting member fixed adjacent said rear side of said side skin and extending vertically adjacent a side edge thereof, said mounting member defining therein a vertically extending channel-like recess which opens rearwardly, and the wall base of said attachment clip being positioned within said channel-like recess and fixedly joined to said mounting member, said mounting member being at least partially insertable within said channel.

12. A wall system according to claim 11, wherein said wall base of said attachment clip has transverse projections formed thereon adjacent opposite lengthwise-extending free edges thereof, and said elongate mounting member has side flanges which lockingly engage with said projections to fixedly secure said wall base within the channel-shaped recess.

* * * * *